United States Patent [19]

Sibley

[11] 4,320,880

[45] Mar. 23, 1982

[54] ELECTRONIC TRACK CURRENT SWITCHING RELAY SYSTEM

[75] Inventor: Henry C. Sibley, Adams Basin, N.Y.

[73] Assignee: General Signal Corp., Rochester, N.Y.

[21] Appl. No.: 85,838

[22] Filed: Oct. 17, 1979

[51] Int. Cl.[3] ..... B61L 3/10

[52] U.S. Cl. ..... 246/34 R; 246/34 B; 246/34 CT; 246/167 R; 370/78

[58] Field of Search ..... 246/34 R, 34 A, 34 CT, 246/34 B, 175, 167 R, 187 B, 28 R; 370/78; 375/17; 340/147 LP

[56] References Cited

U.S. PATENT DOCUMENTS 3,529,150 9/1970 Coupin ..... 246/34 CT 3,868,075 2/1975 Blazek et al. ..... 246/34 CT

*Primary Examiner*—James J. Groody

*Attorney, Agent, or Firm*—Martin LuKacher; Milton E. Kleinman

[57] ABSTRACT

An electronic system which emulates the operation of a polar relay for applying coded pulses to railway tracks has separate signaling circuits having signaling devices responsive to a separate inputs which provide operating power to the circuits. The circuits are interlocked by connecting the inputs to the signaling devices in inverse relationship. One input excludes the other. The signaling devices may be light emitting isolators with switching transistors which control the application of current pulses through the rails of the track while isolating the track battery which supplies the current for these pulses from the local battery which provides the inputs to the signaling circuits. The signaling circuits establish current paths through the light emitting signaling devices at predetermined times after the inputs are applied to emulate the pickup and drop away time of the polar relay. The switching circuits use complementary symmetry power transistors which provide fail safe operation in the signaling system in the event of a short-circuit failure mode throughout. Dual sets of bridge circuits and transient absorbers protect against voltage surges from the track such as may be due to lightning. Operating windings for local circuit relays are connected in series with the power transistors and operate only in response to actual signaling conditions. The signaling circuits and the switching circuits are arranged so that operating current for a circuit which functions to produce track current pulses of one polarity is available only if the circuit which would provide track current pulses of the opposite polarity is inoperative so as to guard against unsafe signaling conditions.

14 Claims, 3 Drawing Figures

ELECTRONIC TRACK CURRENT SWITCHING RELAY SYSTEM

DESCRIPTION

The present invention relates to railway signaling systems and particularly to an electronic track current switching relay system.

The invention is especially suitable for use in replacing polar relays which control the switching in pulsed DC track circuits such as in rate code or track code systems while increasing the reliability without decreasing the fail-safe operating characteristics of such systems. Features of the invention will also be applicable to other systems where only one of two alternative circuit operations at any one time is desired, in spite of the existence of simultaneous inputs which might activate both operations at the same time. Such circuits are sometimes referred to as having a vital function.

Track current switching relays operate at low voltage and high current, typically two to three volts and two to three amperes DC. If the track circuit is shunted, as by a passing train, close to the feed end where the current is applied to the tracks, the current may be several times typical value. Since the track current relay is operating continuously so that it is breaking these large currents, perhaps to 20 to 30 million times a year, contact life of such relays is limited because of this type of operation such that an electronic or solid state switching relay system which eliminates contacts is therefore desirable. Electronic or solid state devices are difficult to apply to track circuit operations because of the low-voltage high current operating conditions. Also signals may be present which would inadvertently operate electronic circuits causing erroneous signals which cannot be tolerated for railway signaling purposes. The electronic system must be connected to a track which may sustain high voltage or current surges, due for example to lightning or induction from power systems, without being damaged. Accordingly, both the operating conditions in railway signaling applications and the incompatibility of electronic and relay switches has militated against their introduction into commercial use in spite of the need for greater reliability and less maintenance and repair which electronic systems can offer.

It is therefore a principal object of the present invention to provide an improved electronically operative system for switching coded current pulses onto railroad tracks for signaling purposes which has fail-safe and current source isolation features of electro-mechanical relay switches and is compatible therewith, while eliminating the problems of requiring frequent maintenance and repair of contacts which accompany the use of electro-mechanical relays.

It is another object of the present invention to provide an improved electronic switching system which is capable of switching current in opposite directions as in the generation of bi-polar signaling pulses and which is interlocked so as to prevent switching in different directions at the same time.

It is a further object of the present invention to provide an improved electronic switching system which operates at low-voltage and high current levels typical in railway signaling applications.

It is a still further object of the present invention to provide an improved electronic switching system which is capable of switching currents, which can increase to several times typical level as when switching track current when the rails are shunted by a passing train close to the point where current is fed thereto.

It is a still further object of the present invention to provide an improved electronic switching system which is protected against high current and voltage surges due for example to lightning or induction from nearby power systems.

Briefly described, a signaling system embodying the invention has first and second signaling circuits, each with an input terminal. These circuits have first and second uni-directionally conductive signaling devices, such as light emitting diodes, which are conductive in a forward direction. Operating current for controlling the signaling circuits is applied as from a local direct current source. This source usually includes a battery in railway signaling operations and is referred as a "local battery." The signaling devices of each circuit are connected in inverse relationship to the terminals such that only one of the devices is actuable at any one time; the other device being interlocked out of operation by being reverse biased. Each signaling circuit defines a path for current through the signaling device thereof which shunts the signaling device of the other signaling circuit and prevents and interlocks the other signaling device from being actuated at the same time as the desired device. Each circuit has means for completing the current path from the input terminal which receives operating current when that circuit is to be actuated. The current path is preferably established through an integrated circuit which is triggered by a circuit having a capacitor which charges and discharges so as to emulate the pickup and drop away time of an electromechanical track switching relay. The signaling devices are optically coupled to a light responsive switching circuit, preferably containing power transistors having complementary symmetry (PNP and NPN). Two switching circuits are provided, one for each of the signaling circuits. The output transistors are connected to the rails of the track to form a pole changing circuit and to switch current from a second DC current source to apply coded pulses of opposite polarity to the track. This second source of current includes a separate battery and such sources are referred to in railway signaling systems as the "track battery." In order to protect the output transistors and the electronic switching circuit against high voltage or current surges, a diode bridge circuit and, if desired a transient absorber circuit including a capacitor and diode of the zener type, may be connected across the battery. Current surges are shifted by the bridge into the track battery and the transient absorber to protect the electronic switching circuit. The coil of a local circuit relay may be connected in series with the output switching transistors for operating local circuit contacts simultaneously with the application of current pulses to the track.

The foregoing and other objects, features and advantages of the invention as well as the presently preferred embodiment thereof will become more apparent from a reading of the following description in connection with the accompanying drawings in which.

Figure 1:
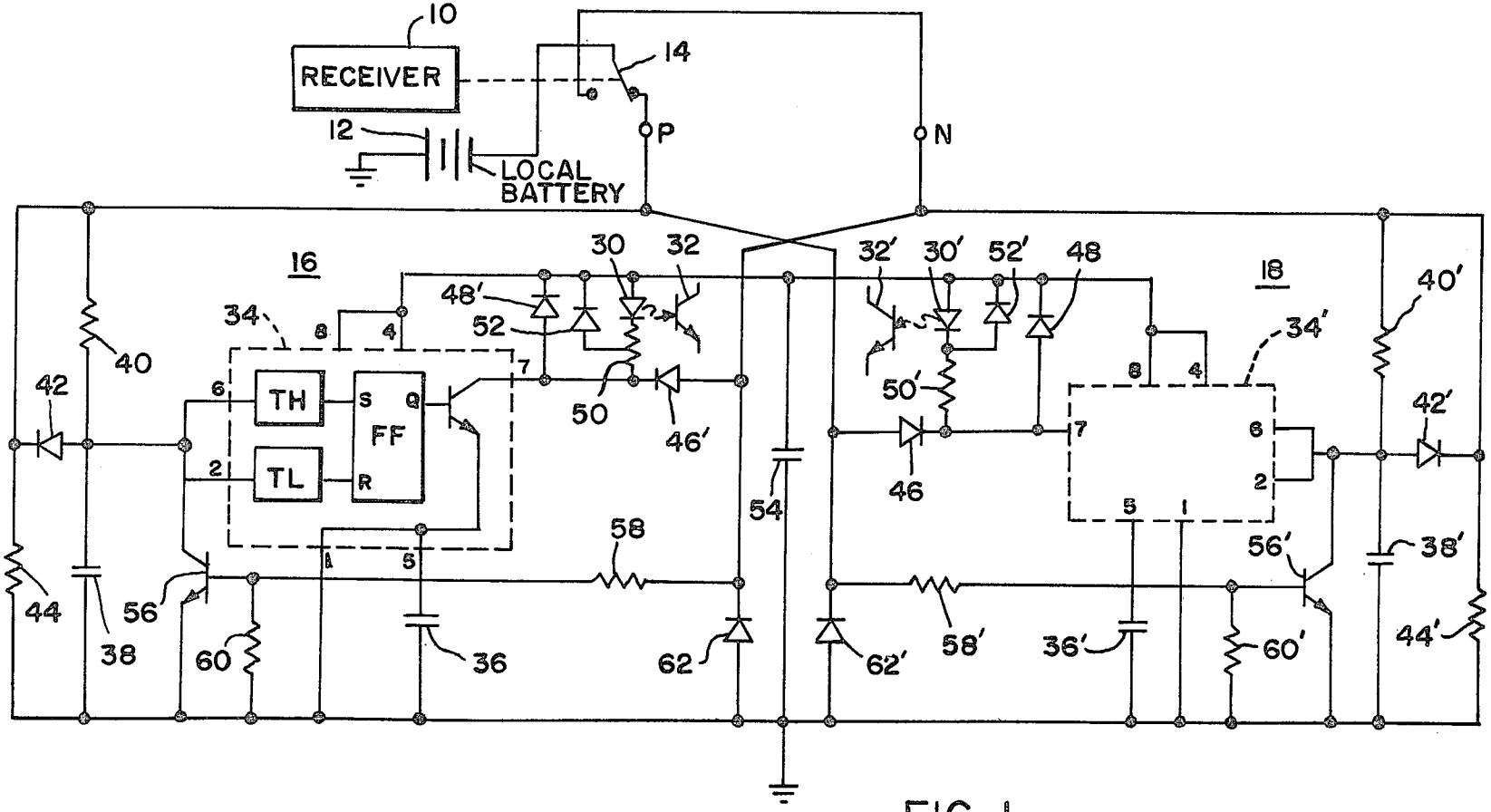
FIG. 1 is a schematic diagram of the signaling circuits of an electronic track current switching relay system embodying the invention.

Referring first to FIG. 1, there is shown a receiver of the type conventionally used in track current signaling and which may include a relay circuit connected to a track section and responsive to signaling currents therein. In order to apply current pulses corresponding to the received signaling currents, a code pulse relay is typically used in railway signaling systems. The input terminals to this relay are known as the P and N terminals. The local battery 12 of the signaling system (shown for purposes of illustration as a storage battery) provides operating current to these terminals via a contact network represented by switch 14 and including contacts operated by the receiver 10. Instead of an electromechanical code pulse relay, an electronic track current switching relay is provided in accordance with the invention. This relay includes signaling circuits 16 and 18 corresponding to the coil circuit of the electromechanical code pulse relay and current switching circuits 20 and 22 (see FIG. 2) corresponding to the contact circuits of the electromechanical relay. These circuits 20 and 22 switch current pulses of opposite polarity from a track battery 24 (shown also for purposes of illustration as a storage battery) and feed these current pulses into a track 26. The track has two rails and provides the load for the switching circuits 20 and 22. Some current always flows along the rails, because of the conductivity of the ballast and the ties. The current level increases when a train is on the track section 26. This current is the greatest when the train is close to the feed point 28 where the switching circuits 20 and 22 are connected to the rails of the track section 26.

The signaling circuits 16 and 18 are similar and are mirror images of each other. The principal difference between the circuits 16 and 18 is how the P and N input terminals are connected thereto so as to interlock the circuits against being operated at the same time. A description of the signaling circuit which is operated when the operating current is applied to the P input terminal will therefore suffice. All of the components of the other signaling circuit 18 which are the same as the corresponding components of the signaling circuit 16 which is associated with the P input terminal are indicated by the same reference numerals with a prime appended thereto. The same connection is used to show corresponding components of the switching circuit 20 and 22.

A uni-directionally conductive signaling device 30 is optically coupled to a phototransistor 32. This transistor 32 is connected in the input of the switching circuit 20 (FIG. 2) and causes that circuit to operate and switch a current of one polarity to the track 26. Associated with the signaling device diode 30 is an integrated circuit 34.

This circuit is a level sensitive digital circuit with a output from pin 7 to pin 1 which is either in a high impedance or low impedance state. The integrated circuit 34 provides a current path through the diode 30 to the return side of the local battery 12 which is indicated as ground. This integrated circuit 34 may be and preferably is the Type 555 timer circuit. Essentially, it includes a high-limit threshold circuit TH and a low-limit threshold circuit TL which triggers a flip flop or latch FF. The Q output of the flip flop, when high, biases an NPN output transistor to its low impedance or conductive state and completes the current path from the light emitting diode 30 to ground internally through the integrated circuit 34. A capacitor 36 is used, as is conventional, to filter the level reference in the integrated circuit against noise. Operating current for the integrated circuit 34 is provided at pins 4 and 8 from the P input terminal. Operating current for the light emitting diode also comes from the P terminal, but only through a path through the other signaling circuit 18 which will reverse bias a light emitting diode 30' which is the signaling device therein.

Figure 2:
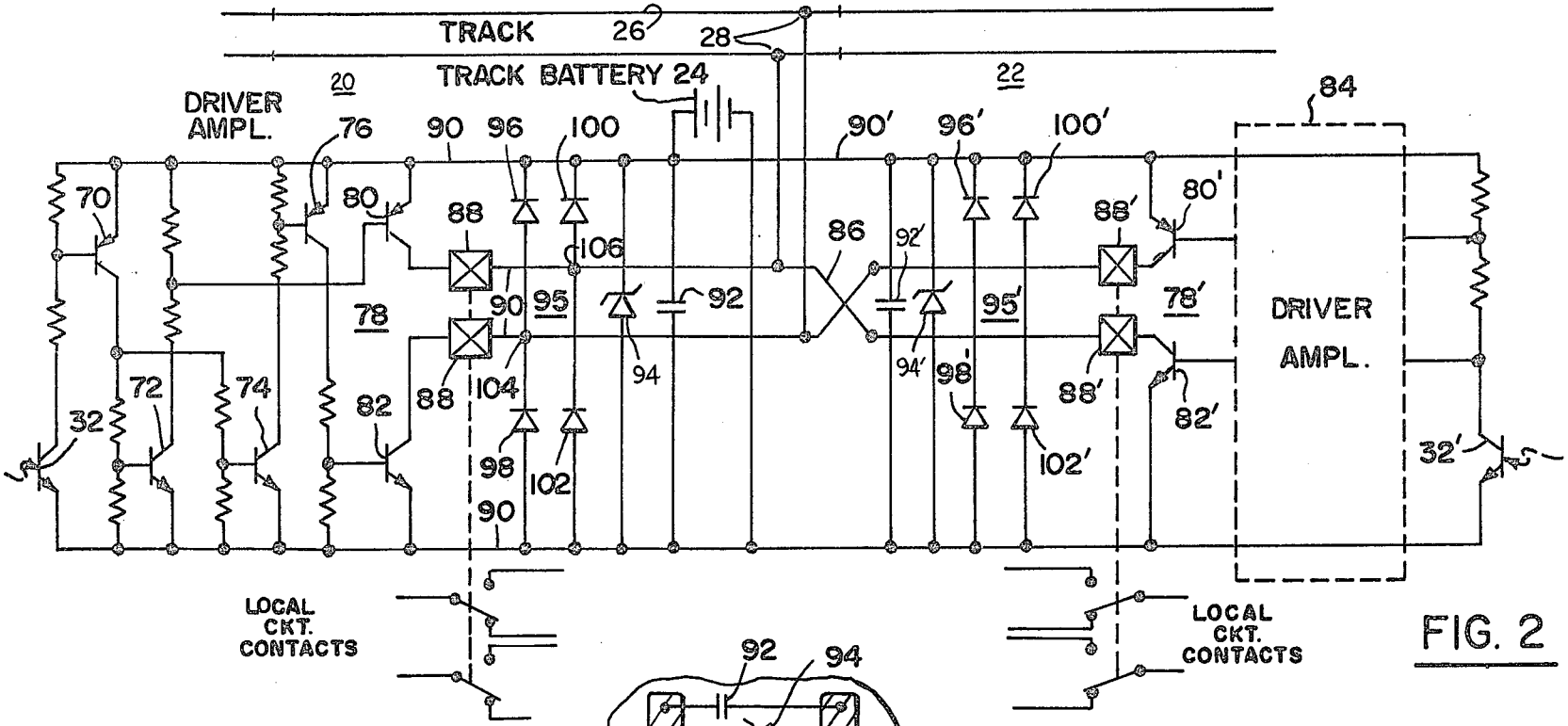
FIG. 2 is a schematic diagram of the switching circuits of the electronic track current switching relay system embodying the invention.

A capacitor 38 is connected to terminals 2 and 6 of the integrated circuit 34 which are the inputs to the high threshold TH and low threshold TL circuits of the integrate circuit 34. This capacitor 38 charges through a resistor 40, the value of which determines the pickup time or predetermined time after the operating current is applied to the input terminal P after which a current pulse of polarity corresponding to the P input is fed to the track 26 (FIG. 2). For example, when the voltage across the capacitor 38 rises to approximately two-thirds of the supply voltage (the voltage of the local battery 12) the high threshold is exceeded and the flip flop sets. When the battery is disconnected from the P input terminal, the capacitor 38 discharges through a diode 42 and a discharge resistor 44. The value of this resistor 44 determines the drop away time or the predetermined time after the operating current is removed from the P input terminal that the current of the polarity corresponding to the P input is removed or switched off from the track 26. The diode 42 may be omitted if the value of the charging resistor 40 is much higher than the value of the discharging resistor 44.

Operating current from the P input is applied to the light emitting diode 30 and to the integrated circuit 34 by way of a pair of diodes 46 and 48 in the other signaling circuit 18. One of these diodes 48 is connected in parallel with the signaling light emitting diode 30' of the other signaling circuit 18. It will be seen that this circuit path provided by the diodes 46 and 48 and particularly the diode 48 connects the signaling device 30 in inverse relationship with the signaling device 30 and in the sense where the signaling device 30' in the circuit 18 is reversed biased and in which the signaling device 30 in the circuit 16 is forward biased. When the flip flop in the integrated circuit 34 is set, the current path through the light emitting signaling device 30 is completed and the device 30 is activated. It will be observed that the N terminal is connected to a similar pair of diodes 46' and 48' to provide current in the forward direction through the signaling device 30' of the circuit 18, when the integrated circuit 34' of that circuit 18 is set to establish the low impedance current path between pins 7 and 1 thereof. Inasmuch as the diode 30 is connected across the diode 48' when the N terminal has operating current fed thereto, the light emitting diode 30 in the signaling circuit 16 is reversed biased. Thus, the diodes 30 and 30' are connected to the N terminal in inverse relationship, but in a sense opposite to the sense in which these diodes 30 and 30' are connected to the P input terminal.

A current limiting resistor 50 is connected in the current path from the light emitting diode 30 through the integrated circuit 34. A diode 52 is connected across the light emitting diode 30 to limit the voltage that can be impressed upon the light emitting diode 30 in a reverse direction. A storage capacitor 54 is charged by the operating current which is applied to either input terminal P or N via the diodes 46 and 48 or the diodes 46' and 48'. This storage capacitor maintains the operating voltage on the integrated circuit for a period long enough to permit the drop away controlling resistors 44 and 44' to control the drop away time of the switching circuit. When the operating current is removed from the P input terminal, the capacitor 38 discharges. The integrated circuit 34 senses a voltage approximately one-third the supply of local battery voltage and resets the flip flop.

In order to assure rapid turn off of the light emitting diode 30 as soon as operating power is applied to the other or N input terminal, a transistor 56 is connected across the capacitor 38. A positive voltage which biases this transistor 56 into full conduction is applied to the base thereof via divider resistors 58 and 60. Accordingly, just as soon as the local battery is switched to the N input terminal, the signaling circuit 16 associated with the P input terminal is de-actuated. A transient suppressing diode 62 is connected between the N input terminal and ground to prevent negative going spikes from affecting the operation of the transistor 56.

The switching circuit 20 is operated by the track battery 24 (see FIG. 2). When the phototransistor 32 is rendered conducted, a driver amplifier having four transistors 70, 72, 74 and 76 drives a complimentary symmetry output stage 78 hard into conduction. This complimentary symmetry stage 78 has a PNP transistor 80 and a NPN transistor 82. The collectors of these transistors 80 and 82 are connected to the rail feed terminals 28 so as to provide a current path from the track battery through the transistor 80, the lower rail of the track 26, the upper rail of the track 26 and through the NPN transistor 82 to the return side of the track battery 24. The signaling circuits and the local battery 12 are isolated from the switching circuit 20 and 22 and the track battery 24 except for the optical links between the light emitting signaling devices 30 and 30' and their associated phototransistors 32 and 32'. The low-voltage, high-current battery 24 may therefore operate independently of the local battery 12. This parallels the electromechanical code pulse relay operation where the relay windings and the contacts which are respectively associated with the local battery and the track battery are isolated from each other.

The other switching circuit 22 has a driver amplifier 84 which is similar to the driver amplifier, containing the transistors 70 to 76, of the switching circuit 20. An output switching stage 78' having complimentary symmetry (NPN and PNP) transistors 80' and 82' is driven hard into saturation by the driver amplifier 84 when the phototransistor 32' is rendered conductive. These output transistors 80' and 82' are connected via a cross-over circuit 86 to the track feed terminals. The cross-over circuit 86 performs a pole changing operation. When the switching circuit output transistors 80' and 82' are conductive, the current from the track battery passes through the transistor 80', the upper rail of the track 26, the lower rail and down through the output transistor 82' to the return side of the track battery 24. The current pulses which are switched by the circuit 22 are of opposite polarity to the pulses which are switched to the rails by the driver amplifier 20.

In the event of a short circuit failure mode of any of the output transistors of one of the switching circuits 20 or 22, current may nevertheless be provided through the output transistors of the other switching circuit. If both the pair of the output transistors of either of the switching circuits fail, a direct current path is provided to the track and constant direct current is applied to the track. This is a safe condition in the railway signaling system since the system is not sensitive or responsive to constant DC current, but responds only to pulses. Accordingly, the connection of the output transistors to each other and to the track 26 provides for fail safe operation.

A local circuit relay associated with the P input terminal is connected between the output transistors 80 and 82 of the switching circuit 20. This relay consists of operating windings 88 which are connected in series with the transistors 80 and 82 so as to balance the circuit connected to the rails of the track 26. The operating winding may be connected between the collectors of the transistors 80 and 82. However, the connection as shown through the rails is preferred so as to avoid the possibility of any current picked up by the track, as from a lightning surge operating the local circuit relay.

Protection against voltage and current surges as may be caused by lightning or induction from adjacent power systems is avoided by the connection of conventional lightning arrestors (not shown) to the lines 90 between the track battery 24 and the rails and the switching circuit 20. Further protection is provided by a transient absorber circuit made up of a capacitor 92 and a zener diode 94 which are connected across the track battery 24; the zener diode being polarized opposite to the polarity of the battery 24. A bridge circuit 95 is made up of four diodes; two of which 96 and 98 are connected in one side of the bridge and the remaining two of which 100 and 102 are connected in the opposite side. The sides of the bridge are connected across the battery 24 in the line 90 with the diodes 96, 98, 100 and 102 polarized in the direction opposite to the polarity of the battery. The junctions 104 and 106, which define the two corners of the bridge are connected to the rails of the track 26. Any current surges, regardless of polarity, are shunted through the diodes 96 and 100 or the diodes 98 and 102 into the track battery 24 and into the transient suppressor which absorbs high energy peaks as may be due to lightning or induction. The output stage 78 of the driver amplifier is thereby protected.

Figure 3:
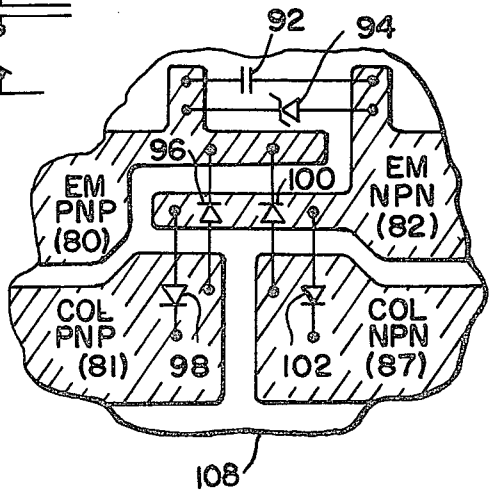
FIG. 3 is a fragmentary plan view of a portion of a printed circuit board on which the transient absorber diode bridge circuit of one of the switching circuits illustrated in FIG. 2 is located.

Referring to FIG. 3, it will be observed how the protection circuits are layed out on the printed circuit board 108. The lands containing the copper layers on the board 108 are indicated by the shaded areas. Large copper areas are provided for the emitters and collectors of the power transistors 80 and 82. These transistors are preferably selected for a low saturation voltage (i.e. the voltage across emitter and collector is made low compared to the track battery voltage.

The interlock circuit paths from the P and N terminals to the signaling devices light emitting diodes 30 and 30' are arranged as on a separate printed circuit board for the signaling circuits 16 and 18, preferably, in a manner similar to the layout illustrated in the schematic diagram of FIG. 1 so that the operating voltage for one of the signaling circuits 16 or 18 will be available only if the other circuit is reversed biased in the event that a circuit conductor opens up.

From the foregoing description, it will be apparent that there has been provided an improved electronic track switching relay system. Variations and modifications of the herein described system, within the scope of the invention will undoubtedly suggest themselves to those skilled in the art. Accordingly, the foregoing description should be taken merely as illustrative and not in a limiting sense.

I claim:

1. A signaling system comprising first and second signaling circuits having first and second unidirectionally conductive signaling devices which are conductive in a forward direction, first and second input terminals for operating current for said first and second circuits, first means for connecting said first and second signaling devices to said first terminal in a first sense, second means for connecting said first and second signaling devices to said second terminal in a second sense, said first and second senses being opposite senses, said first circuit having means for establishing a current path from said first terminal in the forward direction to said first device and said first circuit activating said first device while applying a reverse bias to said second device to interlock said second device against activation at the same time as said first device, said second circuit having means for establishing a circuit path from said second terminal in the forward direction through said second device and said second circuit for activating said second device while applying a reverse bias to said first device against activation at the same time as said second device.

2. The system as set forth in claim 1 further comprising a first source of DC power selectively connectible in the same polarity to said first and second terminals, at least a second source of DC power, first and second switching means for selectively connecting said second DC source across a load, said first and second signaling devices being light emitting when activated, and first and second light responsive devices respectively coupled to said first and second signaling devices, said first and second light responsive devices being connected in said first and second switching means, respectively, for selectively operating said first and second switching means to connect said second DC source across said load when said first source is connected to said first terminal and when said second source is connected to said terminal, while isolating said first and second sources from each other.

3. The system as set forth in claim 2 wherein said second source is a single DC power source, and said first and second switching means include means operative to connect said second source across said load in opposite polarities.

4. The system as set forth in claim 2 wherein said first and second signaling devices are light emitting diodes and said first and second light responsive devices are phototransistors.

5. The system as set forth in claim 2 wherein said load is a railway track having a pair of rails, and said switching means each include a pair of output transistors of complimentary symmetry each connected to provide a series circuit for current from said second source to said rails, a relay for operating local signaling circuits having an operating winding, said operating winding also being connected in a series circuit across said second source via said output transistors.

6. The system as set forth in claim 5 wherein said relay operating winding is also connected in series with said rails.

7. The system as set forth in claim 2 wherein said load is a pair of rails of a railway track and said first and second switching means each have a pair of transistors providing a series circuit across said second source through said rails, at least one bridge circuit including four diodes defining two sides of said bridge, each of said sides having two of said diodes, said sides being connected with said diodes polarized opposite to the polarity of said second source and across said second source, the junction of the diodes in one of said sides being connected to one of said rails and the junction of the diodes in the other of said sides being connected to the other of said rails whereby the current due to voltage surges on said track, such as caused by lightning are directed into said second source for absorption.

8. The system as set forth in claim 7 further comprising at least one transient absorber circuit including a zener diode connected across said second source in opposite polarity thereto and a capacitor also connected across said second source, said second source, said bridge circuit and said transient absorber being connected physically closer to said tracks than said output transistors of said switching means.

9. The system as set forth in claim 8 further comprising a second of said transient absorbers and a second bridge circuit, first lines from said second source and tracks to said first switching means, said first name transient absorber and bridge circuit being connected to said first lines, second lines from said second source and tracks to said second switching means, said second transient absorber and bridge being connected to said second lines.

10. The system as set forth in claim 1 wherein said first signaling circuit includes means connected to said first terminal for establishing and releasing said current path through said first device a predetermined time after operating current is applied and removed from said first terminal, and said second signaling circuit includes means connected to said second terminal for establishing and releasing said current path through said second device a predetermined time after operating current is applied to and removed from said second terminal whereby to emulate the pickup and drop away characteristics of an electromagnetic relay in the activation of said first and second signaling devices.

11. The system as set forth in claim 10 wherein said means for establishing and releasing said current paths to said first and second signaling devices comprises separate capacitors having separate resistors connected in series therewith to said first and second terminals and resistors connected in parallel therewith, first and second integrated circuits responsive to the voltage across different ones of said capacitors and having an output path which is in a low impedance state after said voltage rises above a first predetermined level and before said voltage drops below a second predetermined level, said output path of said first integrated circuit being connected in series with said first device and said output path of said second integrated circuit being connected in series with said second device.

12. The system as set forth in claim 11 further comprising first means connected to said second terminal for discharging the capacitor connected to said first terminal when operating current is supplied to said second terminal, and second means connected to said first terminal for discharging the capacitor connected to said second terminal when operating current is applied to said first terminal.

13. The system as set forth in claim 1 where said first means for connecting said first and second signaling devices to said first terminal includes a first pair of diodes connected polarized in the same direction and in series between said first terminal and said first signaling device, said second signaling device being connected in parallel across one of said pair of diodes, and said second means for connecting said first and second devices to said second terminal includes a second pair of diodes polarized in the same direction and connected in series between said second terminal and said second signaling device, said first signaling device being connected in parallel across one of said second pair of diodes.

14. The system set forth in claim 13 further comprising a storage capacitor connected in series with said first and second pairs of series connected diodes to a common return for said operating current, separate integrated circuits included in said current path establishing means in said first and said second circuit, means for connecting said integrated circuits to said input terminals for controlling the establishment of said current paths, and means connecting said integrated circuits across said storage capacitor for maintaining operating voltage thereon so long as said current path is established and for a predetermined time thereafter.

* * * * *